US005622012A

United States Patent [19]

Schijf

[11] Patent Number: 5,622,012

[45] Date of Patent: Apr. 22, 1997

[54] PANEL, AND ALSO A HINGE SECTION WHICH IS SUITABLE, INTER ALIA, FOR SUCH A PANEL

[76] Inventor: Hendrikus J. Schijf, 4, Robbenzand, 8223 CT Lelystad, Netherlands

[21] Appl. No.: 237,837

[22] Filed: May 4, 1994

[30] Foreign Application Priority Data

May 7, 1993 [NL] Netherlands ..... 9300778
Sep. 8, 1993 [NL] Netherlands ..... 9301551

[51] Int. Cl.[6] ..... E06B 3/48

[52] U.S. Cl. ..... 52/71; 16/355; 52/309.9; 52/588.1; 52/592.2; 160/232; 160/235

[58] Field of Search ..... 52/71, 587.1, 588.1, 52/591.3, 592.2, 592.3, 309.9, 794.1; 160/232, 235, 218, 220; 16/269, 355, 356, 382, 383

[56] References Cited

FOREIGN PATENT DOCUMENTS

| | | | |
|---|---|---|---|
| 382423 | 2/1987 | Austria | 160/218 |
| 159058 | 10/1985 | European Pat. Off. | 160/232 |
| 1368026 | 6/1964 | France | 52/592.3 |
| 1571853 | 7/1980 | United Kingdom | 16/355 |
| 2072248 | 9/1981 | United Kingdom | 160/235 |
| 2157752 | 10/1985 | United Kingdom | 160/232 |
| 2208303 | 3/1989 | United Kingdom | 16/355 |

*Primary Examiner*—Michael Safavi
*Attorney, Agent, or Firm*—Edmund M. Jaskiewicz

[57] ABSTRACT

A panel for so-called sectional doors, in which a number of panels are hinged together by means of hinge parts which form part of the panel. Each panel consists of an elongated body part, which is formed by two side plates lying a distance apart and along the long narrow sides contains the hinge parts for forming the hinged connection. One hinge part contains an arc-shaped nose, the arc-shaped outside wall of which connects virtually directly to one side wall of the body part, and the inside wall running concentrically herewith merges through an acute angle into the other side wall of the body part. The other hinge part has a supporting part lying near one side wall of the body part and bearing an essentially cylindrical thickened part, and a concentric wall running at a distance therefrom which with the thickened part leaves a space free for the accommodation of the nose of the other hinge part of an adjacent panel. This concentric wall extends from the foot of the supporting part to the other side wall of the body part and merges through an acute angle into said wall. Through this shape of the hinge parts, a hinged connection which is safe for fingers is obtained between the panels.

10 Claims, 3 Drawing Sheets

PANEL, AND ALSO A HINGE SECTION WHICH IS SUITABLE, INTER ALIA, FOR SUCH A PANEL

BACKGROUND OF THE INVENTION

The present invention relates to a panel, in particular for overhead doors and the like. Although such a panel can be used for vertically movable articulated garage doors, it can equally be used for horizontally movable articulated doors, which are also known as sectional doors, and in the case of which the adjacent panels have to be able to carry out a specific mutual rotation in order to be able to move the door through an angle of, for example, 90°. A panel of this type is known, for example from GB-A-2157752.

A major disadvantage of this known panel is that when the panels are rotated relative to each other a gap-shaped space is produced between the adjacent panels, which gap closes when the adjacent panels are returned to lie in a common plane. Such a gap means that, particularly in the case of horizontally moving doors, there is a risk of putting one's fingers into the opening and closing gap, and of the fingers becoming trapped, with the serious consequences which this can entail.

Sectional doors with so-called finger protection are currently known. These doors are generally made of panels whose narrow long sides are formed in such a way that the gap arising is too small to be a hazard. The panels in this case are connected to each other by separate hinges. Such doors are complex and are time-consuming to fit.

SUMMARY OF THE INVENTION

The object of the present invention is to provide a panel with hinge incorporated therein, which panel is simple in design, and in the case of which the adjacent panels can pivot relative to each other without the risk of fingers becoming trapped between the panels. These objects are achieved according to the invention by a panel which is characterized in that the arc-shaped outside wall of the nose of the second hinge part extends essentially from one side wall of the panel, while the coaxial inside wall of said nose ends near the other side waal of the panel, and in that the cilindrical thickened part of the first hinge part lies on a supporting part adjoining the abovementioned other side wall, and the arc-shaped waal extends from the foot of said supporting part to the abovementioned one said wall of the panel and merges through a rounded acute angele into said one side wall.

Due to the fact that the arc-shaped external surface of the nose and the arc-shaped wall of the other hinge part interacting therewith both continue virtually to the respective side walls of the panel, no opening and closing gap is now produced when the adjacent panels rotate relative to each other, or in any case the gap is too small for there to be a risk of fingers becoming trapped in it. The shape of the hinge parts therefore provides the desired finger protection, on the one hand, and a suitable hinged connection with the desired strength and stability, on the other.

In a first embodiment of the invention, the first and the second hinge parts are each formed as individual section parts, for example by extrusion, and the parts are then combined with the plates to form a panel, the interior of the panel being foamed up with foam-type plastic such as polyurethane. A panel produced by this method is distinguished by the features described in claim 5. The interior of each section part is in communication with the space between the plates by way of the gap-shaped opening in the bottom wall, so that the interior of the section part is effectively filled up with foam plastic and thereby acquires the desired strength. The anchoring means combined with the foam plastic in this case provide a good connection between the section parts and the plates of the body part. Claims 6–9 indicate other efficient features of panels produced by this method.

In a second embodiment of the panels according to the invention, the hinge parts are formed in a roll-forming operation so that they are in one piece with the respective plates of the body part. In order to form the panel, the two plates need only be placed on top of one another, and the respective connecting edges of the plates come to rest against each other. The interior space between the plates is then foamed up. In the case of this last method, the panels can be made cheaply in a continuous process.

The idea of the invention is also embodied in a hinge section which is obviously intended for use in the production of a panel.

A suitable variant of the hinge section according to the invention can be used effectively in interior doors or cupboard doors.

The invention will be explained in greater detail below with reference to the appended drawing, in which:

DETAILED DESCRIPTION OF THE DRAWINGS

The same parts or parts having the same function are indicated as far as possible by the same reference numbers in the various figures.

Figure 2:
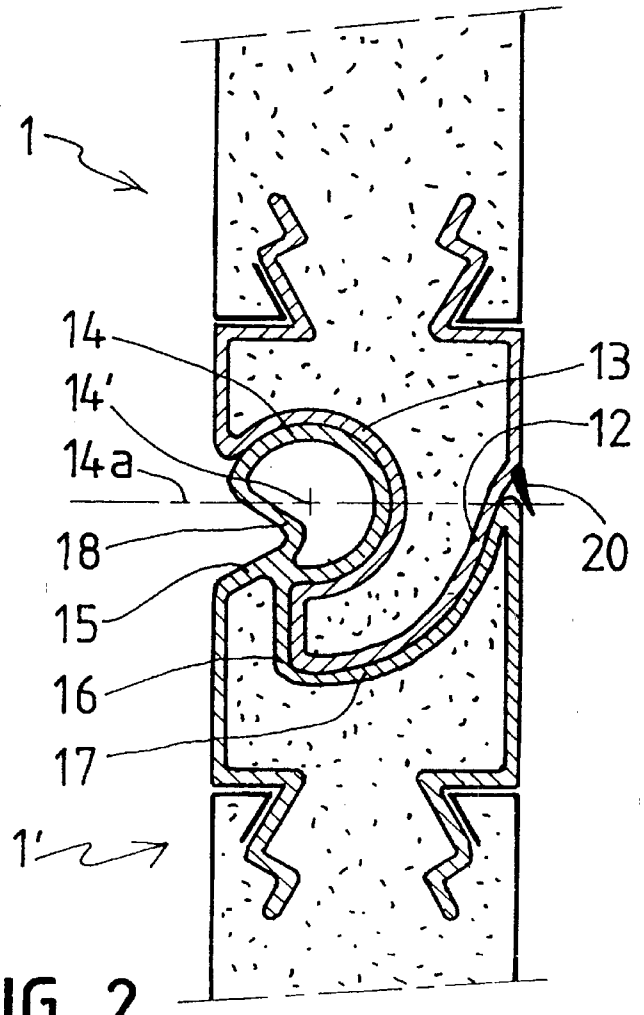
FIG. 2 shows a cross-section corresponding to that of FIG. 1, in which the two panels lie in a common plane.
Figure 1:
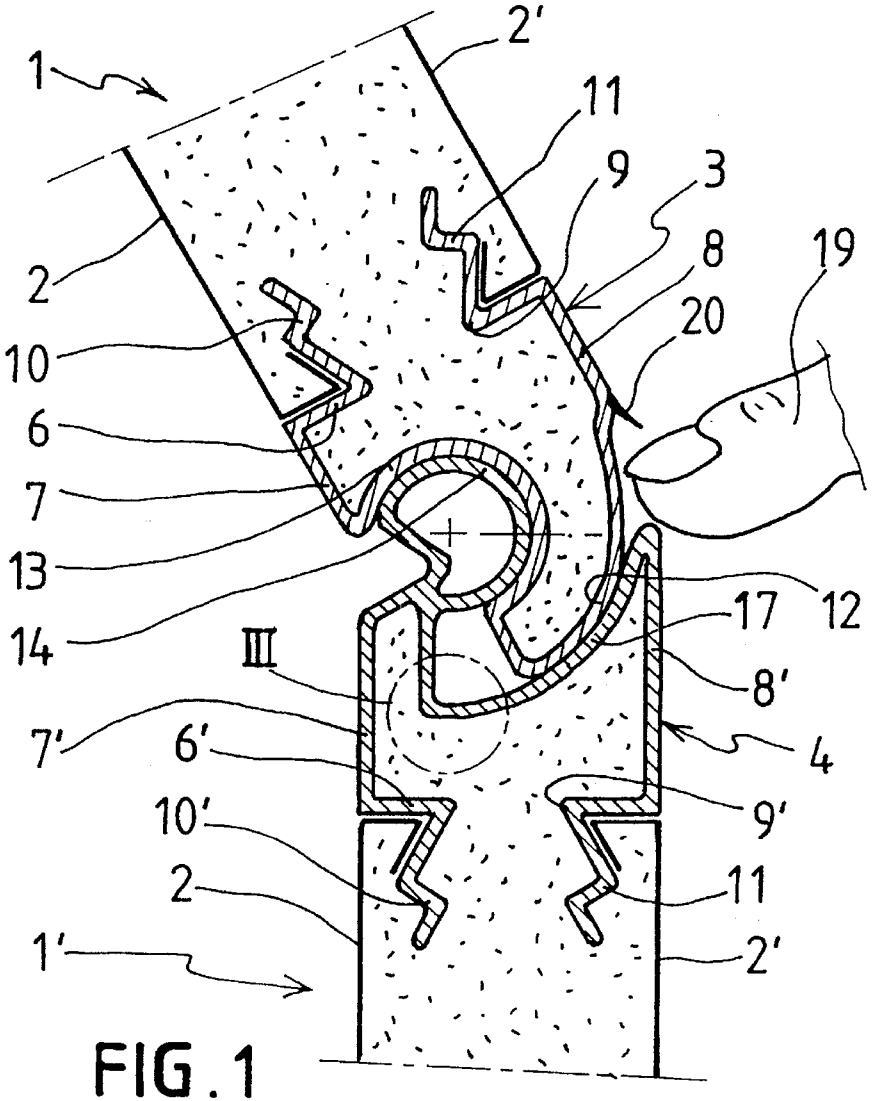
FIG. 1 shows a cross-section of the hinged connection between two adjacent panels according to the invention, in which the panels are rotated slightly relative to each other.

FIGS. 1 and 2 show in cross-section the hinged connection between two identical panels 1 and 1'. These are in fact panels of the type in current use for the production of so-called sectional doors, used as garage doors or as doors for factory halls and/or stores. The panels here are each elongated in shape and are made up of two parallel side plates 2, 2' which are spaced apart and along the long narrow sides enclose between them a hinge part 3, 4 respectively. The two hinge parts are formed here as separate section parts produced by extrusion. It will be clear that each panel has a hinge part 3 along one narrow side and a hinge part 4 along the other narrow side, so that a succession of hingedly connected panels can be formed by always hooking the hinge parts 3 and 4 into each other in a manner which is known per se.

Each hinge part 3; 4 has a bottom wall 6; 6' with two side walls 7, 8; 7', 8' positioned at right angles thereto and lying in line with the respective side plates 2, 2'. The two side walls are again connected to each other at their ends facing away from the bottom wall by way of a wall which forms the actual hinge, and the shape of which will be described in detail below.

Each bottom wall 6; 6' has a longitudinal gap-shaped opening 9; 9', the side edges of which are each provided with a flange 10, 11; 10', 11', extending from the bottom wall 6; 6' in a direction opposite to that of said side walls The flanges 10, 11; 10', 11' each contain a rectilinear part diverging from the gap-shaped opening, against which part a flanged edge part of the side plates 2, 2' always rests. After this diverging part, the flanges run in a corrugated or stepped shape over some distance in the space between the two side plates 2, 2'. By way of the gap-shaped opening 9, 9' the interior space of each hinge part, which is surrounded by the bottom wall, the side walls and the wall forming the hinge, is in communication with the space between the side plates 2, 2'. When the space between the side plates 2, 2' is filled up with foam-type plastic, for example polyurethane foam, the interior space of the hinge parts is also filled with this foam-type plastic. For this purpose, the flanges 10, 11; 10', 11' are shaped in such a way that they do not impede the flow of the foam-type plastic into the hinge parts. The flanges also ensure a firm anchoring of the hinge parts to the side plates, while the hinge parts themselves acquire additional strength and stability from the foam-type plastic.

As can be seen clearly from the drawing, the hinge part 3 has an arc-shaped nose, which is formed by an arc-shaped outside wall 12, which connects by means of a transitional area to the side wall 8, and at the free end of the nose runs back into an arc-shaped inside wall 13 running coaxially at a distance from the outside wall 12 and then merging through a rounded acute angle into the other side wall 7. In this way the nose extends over the full width of the hinge part 3.

Near one side wall 7', the other hinge part 4 has a cylindrical thickened part or hinge pin 14, which is intended for placing in a close fit in the cavity formed by the inside wall 13 of the nose. The thickened part is supported by a supporting part, which is formed by an inward slanting extension 15 of the side wall 7' and a wall part 16 running virtually parallel to the side wall 7' and at a distance therefrom. The wall part 16 merges through a rounded angle into an arc-shaped wall 17, which in turn runs concentrically at a distance from the cylindrical thickened part 14, which wall 17 continues to the other side wall 8' and merges into it through a rounded acute angle.

At the side facing the side wall 7', the cylindrical thickened part 14 is provided with a recess 18, which serves for the insertion of said thickened part into the cavity formed by the nose of the other hinge part 3. As can be seen clearly in the drawing, the hinge parts 3 and 4 are dimensioned in such a way that in the combined state shown in the drawing the thickened part 14 fits closely into the cavity formed by the inside wall 13 of the nose, while the outside wall 12 of the nose rests against the arc-shaped wall 17 of the other hinge part 4. Since the wall 17 merges through a rounded acute angle into the wall 8', and the outside wall 12 of the nose merges gradually into the side wall 8, when the panels are rotated relative to each other no gap in which a finger can be caught is produced. A finger 19 is shown in FIG. 1 in order to illustrate this.

As shown in FIGS. 1 and 2, near the transition of the side wall 8 into the arc-shaped wall 12, the hinge part 3 is provided with a sealing lip 20 extending over the full longitudinal length of the panel. This lip is made of a flexible soft plastic and in the position of the panels 1, 1' shown in FIG. 2 shuts off the gap between the hinge parts 3 and 4 in order to prevent the penetration of rainwater and/or dirt. The sealing lip is preferably produced by co-extrusion during the extrusion of the section part.

The outside wall 12 of the nose is staggered inwards slightly relative to the side wall 8 and merges into said wall through a transitional area in the form of a shallow S-bend. This is necessary in order to make the arc-shaped wall 17 of the other hinge part 4 continue as far as possible. According to the invention, the rounded acute angle through which the wall 17 merges into the side wall 8' lies at least above the face 14*a* which is at right angles to the face of the panel 1' and runs through the axis 14' of the thickened part 14 (see FIG. 2). This ensures that the outside wall 12 of the nose remains in contact with the wall 17 of the other hinge part when the two panels have been rotated through the maximum possible angle relative to each other. In this position of the panels also, the protection of the fingers is then maintained.

Figure 3:
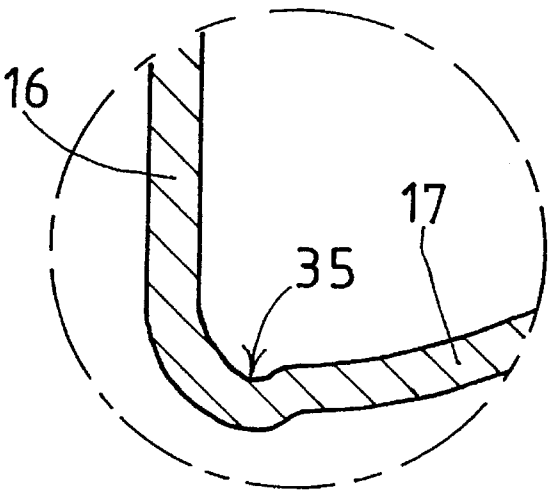
FIG. 3 shows on a greatly enlarged scale the detail III from FIG. 1.

FIG. 3 shows the detail III in FIG. 1 on a greatly enlarged scale. This detail shows the transition of the wall 16 of the supporting part into the arc-shaped wall 17. As can be seen from this detail, a tapered recess 35, forming a longitudinal channel, is provided on this transition. Any moisture which has collected in the hinge section can flow away along this channel to the sides of the panel.

Figure 4:
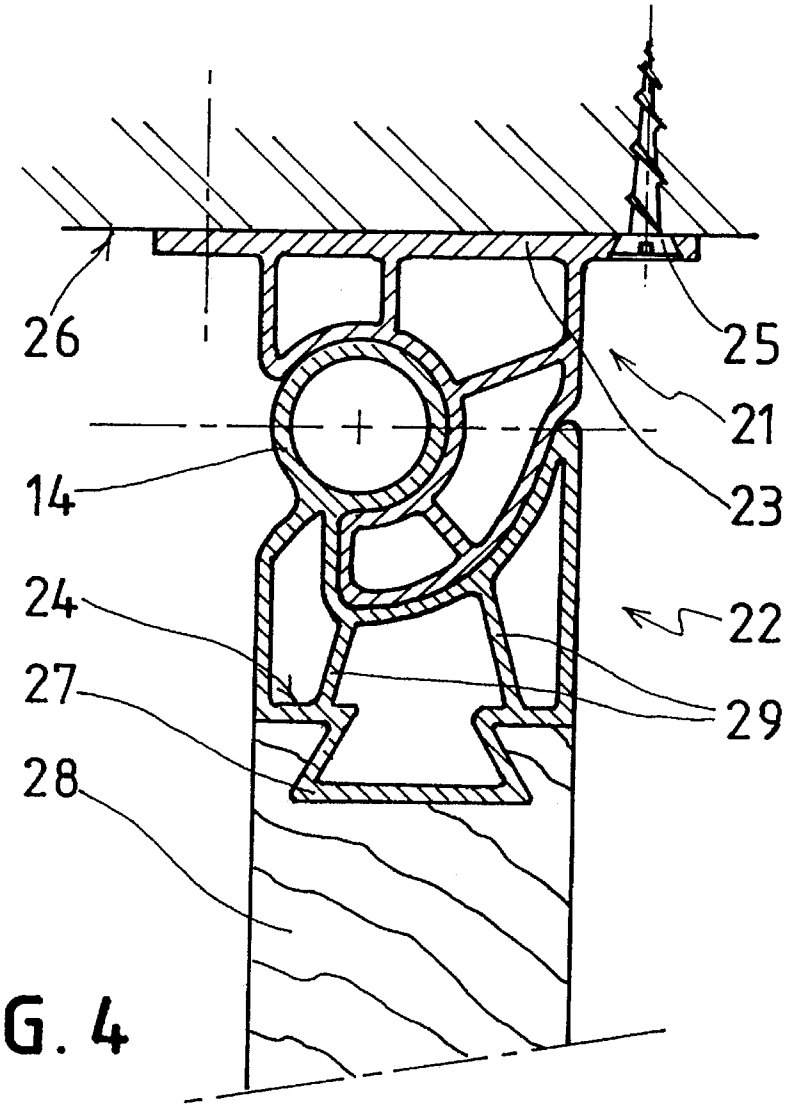
FIG. 4 shows a variant of the hinge section according to the invention.

Finally, FIG. 4 shows a variant of the hinge section according to the invention which can be used as a hinge for an inside door or cupboard door. As regards the hinge action, the two section parts 21 and 22 have essentially the same configuration as the hinge parts in FIGS. 1 and 2. The same reference numbers are therefore used as far as possible for the same or corresponding parts. Unlike the hinge parts from FIGS. 1 and 2, the cylindrical thickened part 14 has no recess 18 for hooking the section parts 21 and 22 into each other. The section parts 21 and 22 therefore have to be slid axially into each other in this embodiment.

However, the essential difference from the hinge parts of FIGS. 1 and 2 is the shape of the bottom walls 23 and 24 of the respective section parts 21 and 22. The bottom wall 23 of the section part 21 consists of a flat closed wall running past the side walls 7 and 8 in order to form side flanges, by means of which this section part can be fixed to a wall 26, for example by means of screws 25. The bottom wall 24 of the other section part 22 also consists of a closed wall which between the side walls 7' and 8' of the hinge part is provided with a dovetailed projection 27, by means of which the section part 22 can be connected to a door leaf 28 or the like. This produces a hinged door with a finger-protecting hinge section extending over the entire height of the door. Since the interior space of said hinge section is not filled up with foam plastic, each hinge part 21 and 22 is provided with a number of inside reinforcement walls 29, in order to provide the necessary stability and strength.

Figure 5:
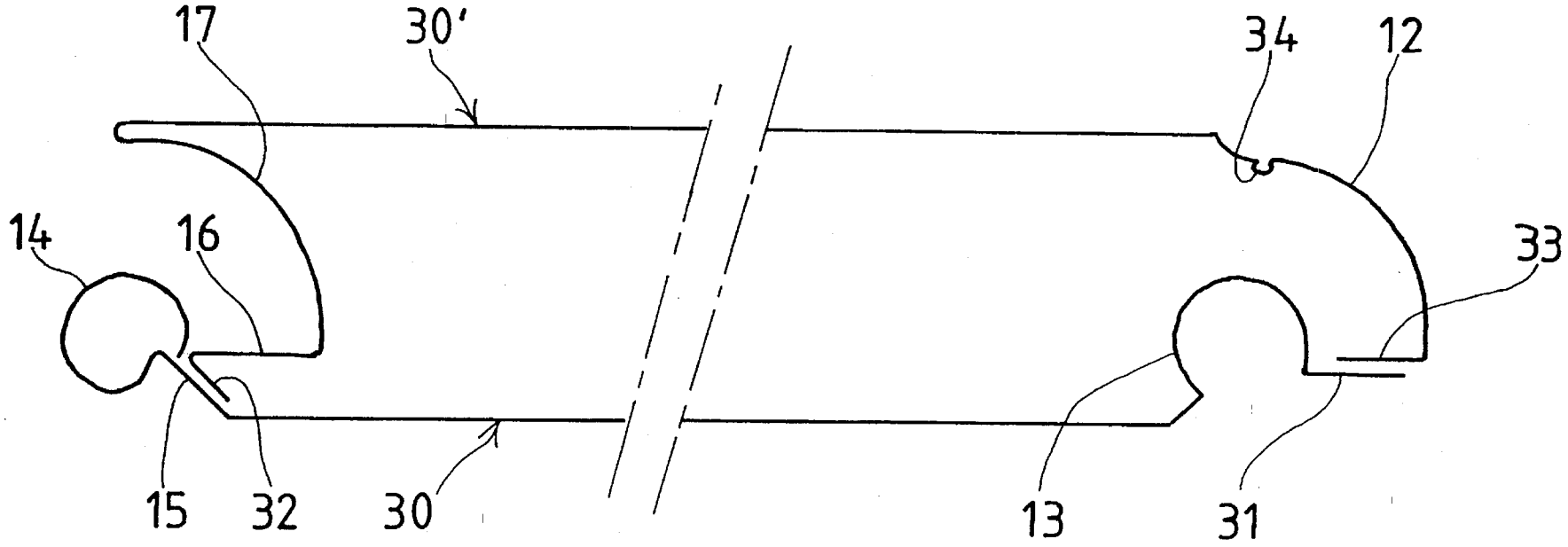
FIG. 5 shows a variant of the panel according to the invention, in which the hinge parts are made integral with the side plates.

FIG. 5 shows another embodiment of the panel according to the invention, in which the hinge parts are not made as separate section parts, but are formed in a roll-forming operation directly in the long side edges of the plates 30, 30' of the panel. For the sake of clarity, the two plates 30, 30' are shown a slight distance apart in this figure.

As can be seen from this figure, at once long side the plate 30 contains a part of the hinge part 4, i.e. the inward-slanting wall 15, which continues through a suitable rounded part into the cylindrical thickened part 14. At the other long side, the plate 30 contains a part of the hinge part 3, i.e. the internal arc-shaped inside wall 13 of the nose to which a straight connecting edge 31 connects, which edge runs parallel to the plane of the plate.

The plate 30' also contains the remaining part of the hinge part 4 at one long side, i.e. the arc-shaped wall 17 and the wall 16 of the supporting part. A straight connecting edge 32, which runs parallel to the slanting wall 15 of the other plate when the plates are combined, connects to the wall 16. At the other long side, the plate 30' contains the arc-shaped outside wall 12 of the nose, to which a connecting edge 33 running parallel to the plane of the plate subsequently connects.

The two plates 30, 30' are combined, at one side the connecting edge 32 resting against the slanting wall 15, and at the other side the two connecting edges 31 and 33 resting against each other. The interior space between the two plates is then foamed up with e.g. polyurethane foam. Due to the fact that the two plates 30, 30' are made by roll-forming, the shape at less important points can deviate slightly from the embodiment described above. The outside wall 12 of the nose thus contains a recess 34 near the connection to the flat part of the plate, which recess serves to accommodate a sealing strip which has the same function as the sealing strip 20 of the previous embodiment.

It will be clear that the invention is not limited to the embodiment illustrated and described here, but that a large number of other variants are possible within the scope of the appended claims. For example, the means by which the hinge parts 21 and 22 are fixed to a wall or door leaf can differ from those which are illustrated and described here.

The transition area between the side wall 8 and the outside wall 12 of the nose is in the form of a shallow S-bend in the first embodiment. This transition area could also be designed differently, e.g. with large radii of curvature or with obtuse angles, or it could even be a continuous transition.

Finally, the arc-shaped faces 12 and 17 of the nose can also be provided with grooves several tenths of a millimeter deep, running in the longitudinal direction of the panel. These grooves, which are not shown in the drawing, serve for lubrication purposes and for preventing the panels from freezing up.

What is claimed is:

1. Panel (1,1') for forming a garage door or the like comprising an elongated body part having first and second long narrow sides, a first hinge part (4) on said first long narrow side and a second hinge part (3) on said second long narrow side and both hinge parts extending over the length of the panel, said second hinge part having an arc-shaped nose, said first hinge part having an arc-shaped thickened part (14) to define a hinge pin and further having a first arc-shaped wall (17) spaced from said thickened part and coaxial therewith to define therewith a space to accommodate said nose of a second hinge part on an adjacent body panel such that said nose can grip around said thickened part to form a hinged connection between adjacent body panels, said body part further comprising two flat parallel plates defining side walls and spaced to define a space there between filled with a foam plastic, the nose of said second hinge part has an arc-shaped outer wall (12) extending from one side wall of the body part, said nose having an inside arc-shaped wall (13) coaxial with said thickened part and ending at the other side wall of the body part, said thickened body part of said first hinge part disposed on supporting portions (15,16) adjoining said other side wall, said first arc-shaped wall (17) extending from the base of said supporting part to said one side wall of the body part and merging to a rounded acute angle into said one side wall, the merging of said first arc-shaped wall and said one side wall being disposed on or past a plane passing through the axis of the thickened part and at right angles to the plane of the body part, the outside wall (12) of the nose of the second hinge part is provided with a sealing strip (20) near the merging of said first arc-shaped wall with the adjacent side wall of the panel.

2. Panel according to claim 1, wherein the cylindrical thickened part (14) is provided with a notch (18), which at one side is defined by a continuation of an inward-slanting wall part (15) of the supporting part, which continuation runs back through a rounded acute angle to the circular wall of the thickened part.

3. Panel according to claim 2, in which the first and the second hinge part are formed as separate section parts which are combined wit the plates of the body part, wherein each hinge part is formed by a bottom wall (6,6') with two side walls (7, 8; 7',8') at right angles thereto, each connecting in an essentially flat manner to the plates (2,2') of the body part, while the bottom wall is also provided with anchoring means (10, 11; 10', 11') extending from the bottom wall to a point between the plates of the body part.

4. Panel according to claim 3, wherein the anchoring means are formed by flanges which bound the gap-shaped openings and which are each provided with one or more flange parts diverging from the gap-shaped opening.

5. Panel according to claim 4, wherein the long side edges of the plates of the body part are flanged inwards, and each rest at least with part of the flanged edge against a diverging flange part of the anchoring means.

6. Panel according to claim 4, wherein the supporting part (15, 16) is formed by the side wall, an inward-slanting wall part (15) and a wall part(16) which runs back virtually parallel to the side wall and merges into the abovementioned arc-shaped wall (17), a tapered recess (35), forming a longitudinal drainage channel, being provided on the transition from the wall part to the arc-shaped wall.

7. Panel according to claim 6, wherein the inside wall (13) of the nose of the second hinge part has shallow grooves running in the longitudinal direction.

8. Panel according to claim 2, wherein the hinge parts are formed integrally with the respective plates (30, 30') of the body part of the panel, one plate (30') at one side containing the arc-shaped outside wall (12) of the nose, which wall ends with a connecting edge (33) running inwards parallel to the plane of the panel, and at the other side bearing the arc-shaped wall (17) with the inside wall (16) of the supporting part, which inside wall ends with a slanting connecting edge (32), while the other plate (30) of the body part at one side contains the inside wall (13) of the nose and ends with a connecting edge (31) running parallel to the plane of the panel, and at the other side contains the inward-slanting wall (15) of the supporting part and the thickened part (14) in the form of a bead.

9. Panel according to claim 8 wherein the outside wall of the nose near a transition to a said side wall of the body part is provided with a longitudinal recess (34) for the accommodation of a sealing strip.

10. Panel according to claim 6 wherein the outside wall (12) of the nose of the second hinge part has shallow grooves running in the longitudinal direction.

* * * * *